US008763328B2

(12) United States Patent
Tuttle

(10) Patent No.: US 8,763,328 B2
(45) Date of Patent: Jul. 1, 2014

(54) SLAB BASED MODULAR BUILDING SYSTEM

(76) Inventor: Robert Floyd Tuttle, Dana Point, CA (US)

( * ) Notice: Subject to any disclaimer, the term of this patent is extended or adjusted under 35 U.S.C. 154(b) by 0 days.

(21) Appl. No.: 12/660,858

(22) Filed: Mar. 5, 2010

(65) Prior Publication Data

US 2010/0223867 A1 Sep. 9, 2010

Related U.S. Application Data

(60) Provisional application No. 61/209,407, filed on Mar. 5, 2009.

(51) Int. Cl.
*E02D 27/02* (2006.01)
*E02D 27/08* (2006.01)
*E04B 1/16* (2006.01)

(52) U.S. Cl.
USPC ..... 52/295; 52/292; 52/414

(58) Field of Classification Search
USPC ..... 52/294, 295, 296, 297, 298, 299, 414, 52/169.9, 292
See application file for complete search history.

(56) References Cited

U.S. PATENT DOCUMENTS 4,074,474 A * 2/1978 Cristy ..... 52/2.11
4,685,258 A * 8/1987 Av-Zuk ..... 52/126.6
D320,485 S * 10/1991 Huang ..... D34/31
D320,685 S * 10/1991 Huang ..... D34/31
5,072,557 A * 12/1991 Naka et al. ..... 52/126.6
5,390,455 A * 2/1995 Antolini ..... 52/299
5,460,499 A * 10/1995 Franklin ..... 425/65
5,469,684 A * 11/1995 Franklin ..... 52/745.13
5,483,780 A * 1/1996 Stumpf ..... 52/650.3
5,564,235 A * 10/1996 Butler ..... 52/126.6
5,830,378 A * 11/1998 Butler ..... 249/18
5,906,076 A * 5/1999 McManus ..... 52/126.5
5,946,867 A * 9/1999 Snider et al. ..... 52/167.1
6,550,213 B1 * 4/2003 Butler ..... 52/741.15
6,874,288 B1 * 4/2005 Washa et al. ..... 52/371
7,596,915 B2 * 10/2009 Lee et al. ..... 52/223.6
7,677,522 B2 * 3/2010 Bakos ..... 248/500
8,256,172 B2 * 9/2012 Benson ..... 52/220.1
8,302,357 B1 * 11/2012 Nolte ..... 52/294
8,528,296 B1 * 9/2013 Miller ..... 52/741.15
2003/0033760 A1 * 2/2003 Rogers et al. ..... 52/167.7
2003/0233798 A1 * 12/2003 Berkey et al. ..... 52/223.7
2004/0093817 A1 * 5/2004 Pujol Barcons ..... 52/294
2005/0262786 A1 * 12/2005 Messenger et al. ..... 52/309.12
2006/0000168 A1 * 1/2006 Compton ..... 52/292
2007/0289239 A1 * 12/2007 Lee et al. ..... 52/426
2008/0016805 A1 * 1/2008 Walter ..... 52/263
2009/0320393 A1 * 12/2009 Meyer et al. ..... 52/223.6
2010/0132292 A1 * 6/2010 Gullette ..... 52/378
2011/0030288 A1 * 2/2011 Traulsen et al. ..... 52/126.1
2011/0138736 A1 * 6/2011 Brown ..... 52/741.11
2011/0146181 A1 * 6/2011 Traulsen et al. ..... 52/474
2012/0003051 A1 * 1/2012 Plotkin ..... 405/229
2012/0110928 A1 * 5/2012 Liberman ..... 52/122.1
2012/0117911 A1 * 5/2012 Trenerry ..... 52/650.3
2012/0297701 A1 * 11/2012 Oakley ..... 52/127.3

* cited by examiner

*Primary Examiner* — Basil Katcheves
*Assistant Examiner* — Rodney Mintz
(74) *Attorney, Agent, or Firm* — Kelly H. Hale

(57) ABSTRACT

Embodiments of a slab based building system implementing a modular grid are presented herein. The square or rectangular grid may incorporate a connection point with vertical adjustment means for providing precise location of the grid elements relative to each other. An edge form is adapted to attach to the grid system. Additional building elements, such as pre-fabricated walls may be attached at the connection points.

12 Claims, 8 Drawing Sheets

SLAB BASED MODULAR BUILDING SYSTEM

CROSS REFERENCE TO RELATED APPLICATIONS

The present application claims the benefit of U.S. Provisional Patent Application No. 61/209,407, filed Mar. 5, 2009, entitled "Slab Based Modular Building System," which is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

FIELD OF THE INVENTION

This application relates generally to building systems and, more specifically, to building systems utilizing slab-on-grade foundations.

BACKGROUND

Shallow foundations and more particularly slab-on-grade ("slab") foundations provide the advantages of being cheap and sturdy alternatives to other building methods used in appropriate climates. Because they are formed at the building site, however, it is often difficult or even impossible for slab foundations to meet the strict tolerances required for the use of pre-fabbed or other manufactured components. Additionally, to meet cost objectives labor costs must be kept low, mandating the use of workers with little or no training.

Thus, there is a need for a slab foundation and associated system that provides precise and accurate dimensional control while reducing the need for skilled workers.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 2:
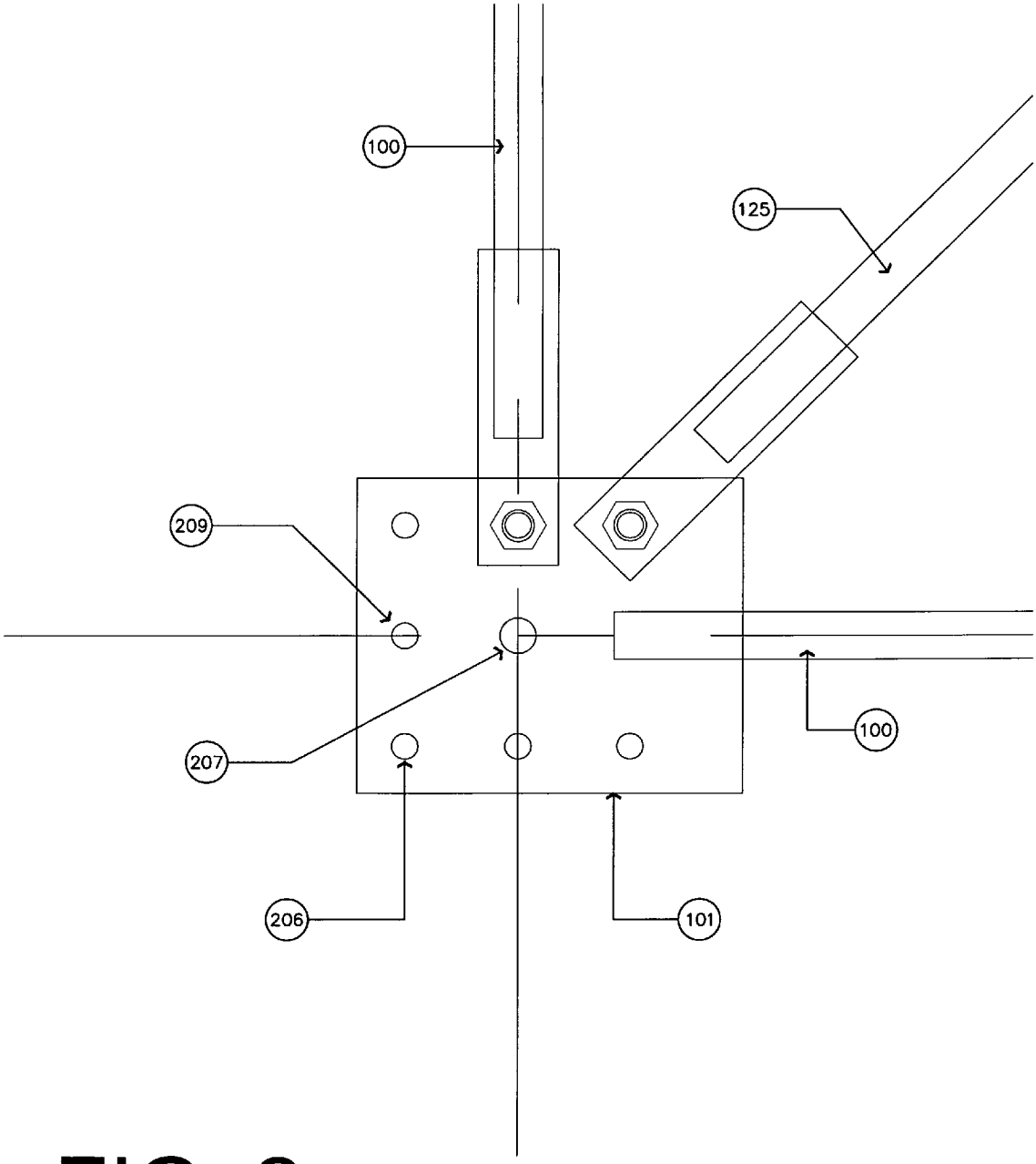
FIG. 2 illustrates a connector for the grid system of FIG. 1, according to embodiments of the present invention.
Figure 3:
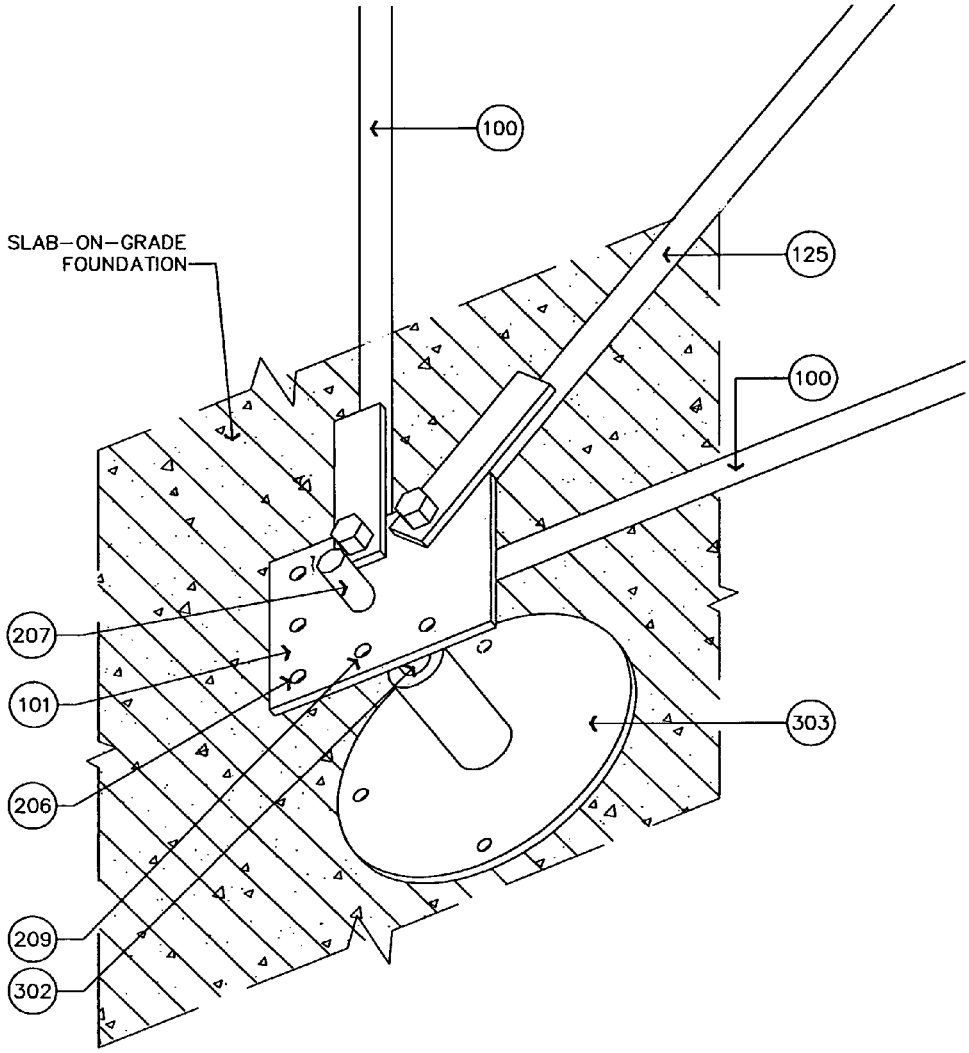

FIG. 3 provides a detailed view of the connector illustrated in FIG. 2, according to embodiments of the present invention.

Figure 1:
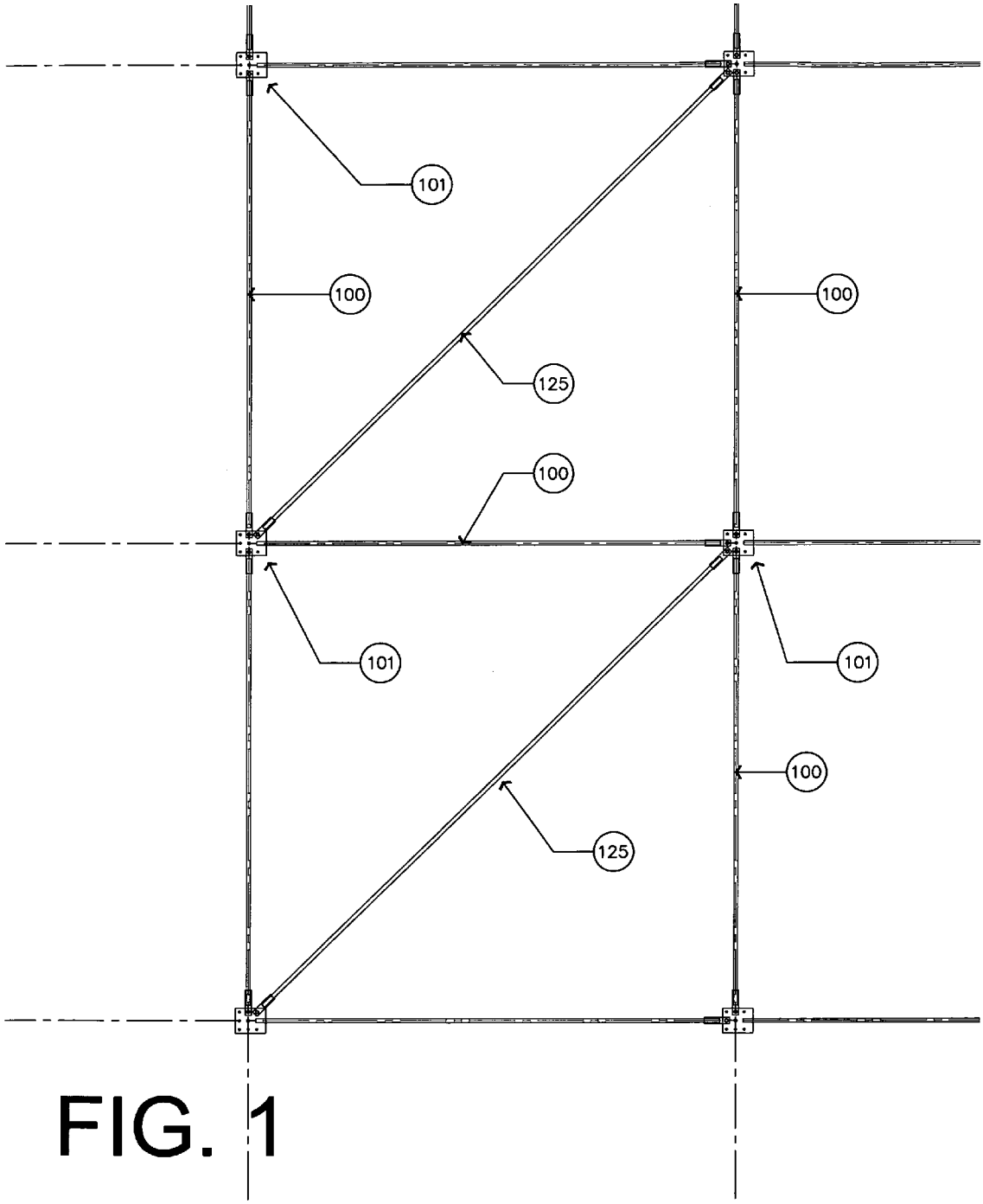
FIG. 1 illustrates a grid system for use in the slab or floor of a building according to embodiments of the present invention.
Figure 4:
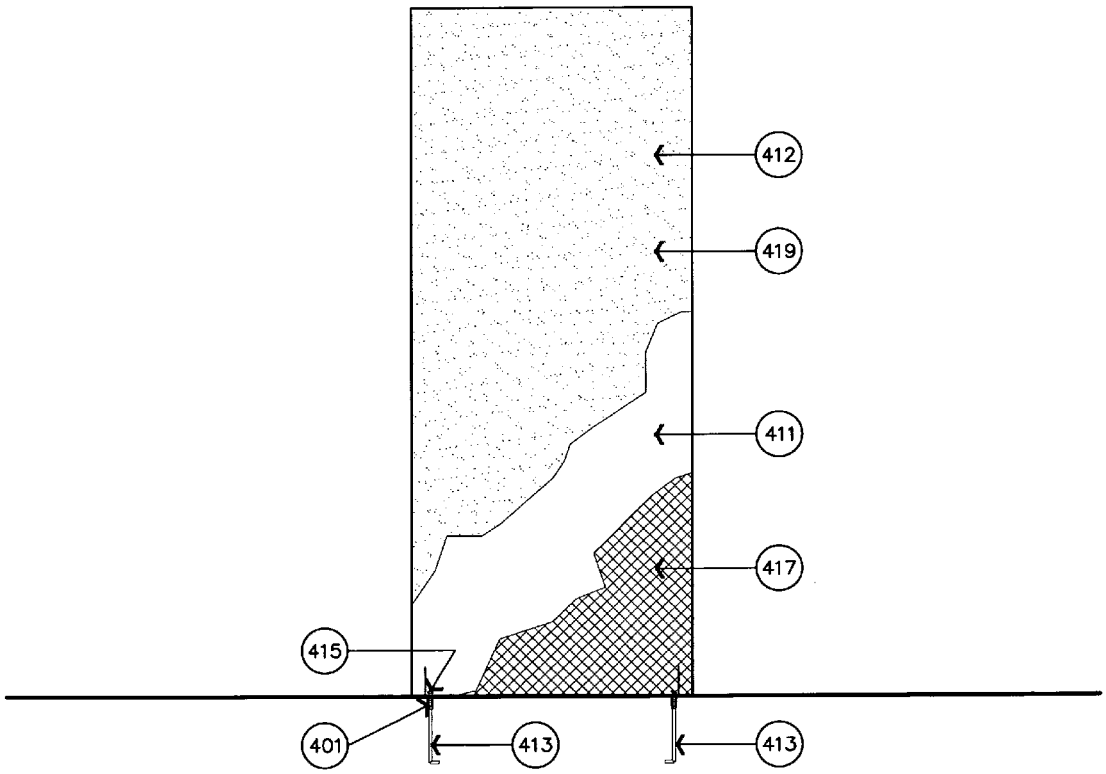

FIG. 4 illustrates an exemplary wall panel for the grid system illustrated in FIG. 1, according to embodiments of the present invention.

Figure 5:
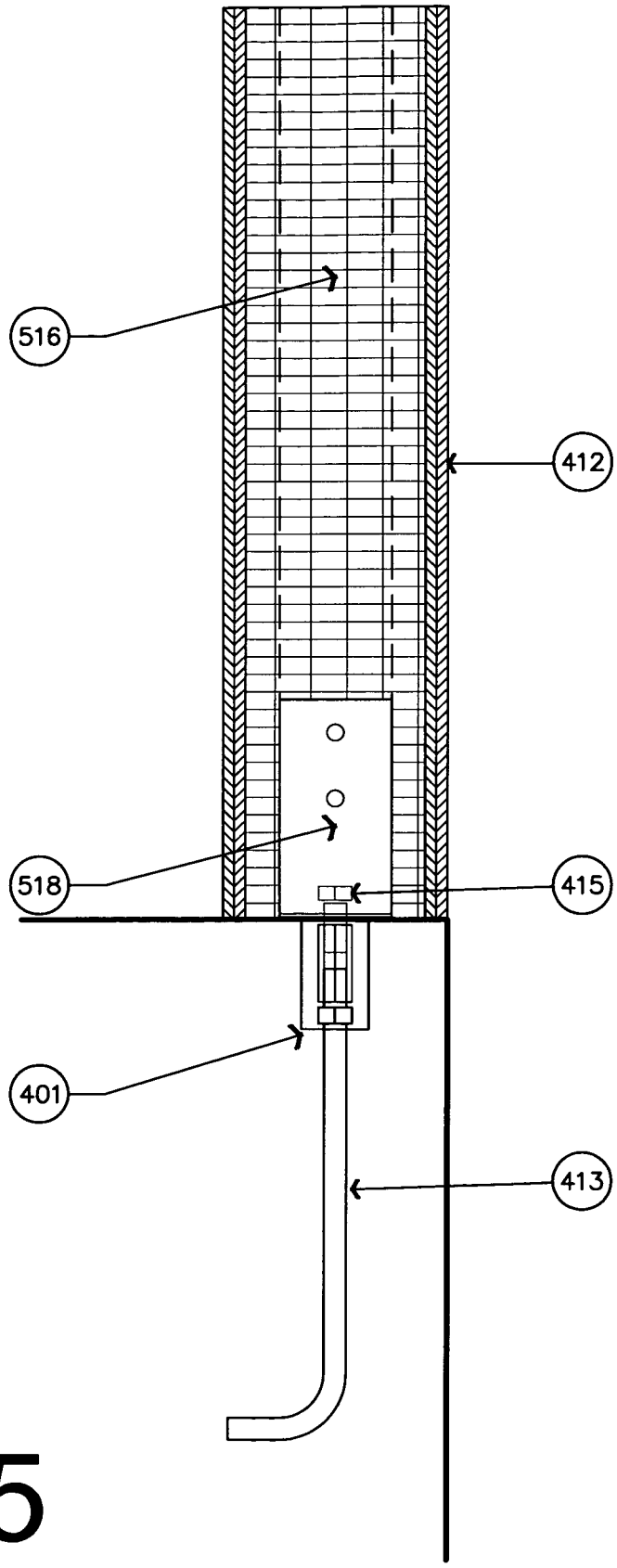

FIG. 5 illustrates an embodiment for wall to floor connection and for providing electrical and other wired materials in the wall panel illustrated in FIG. 4.

Figure 6:
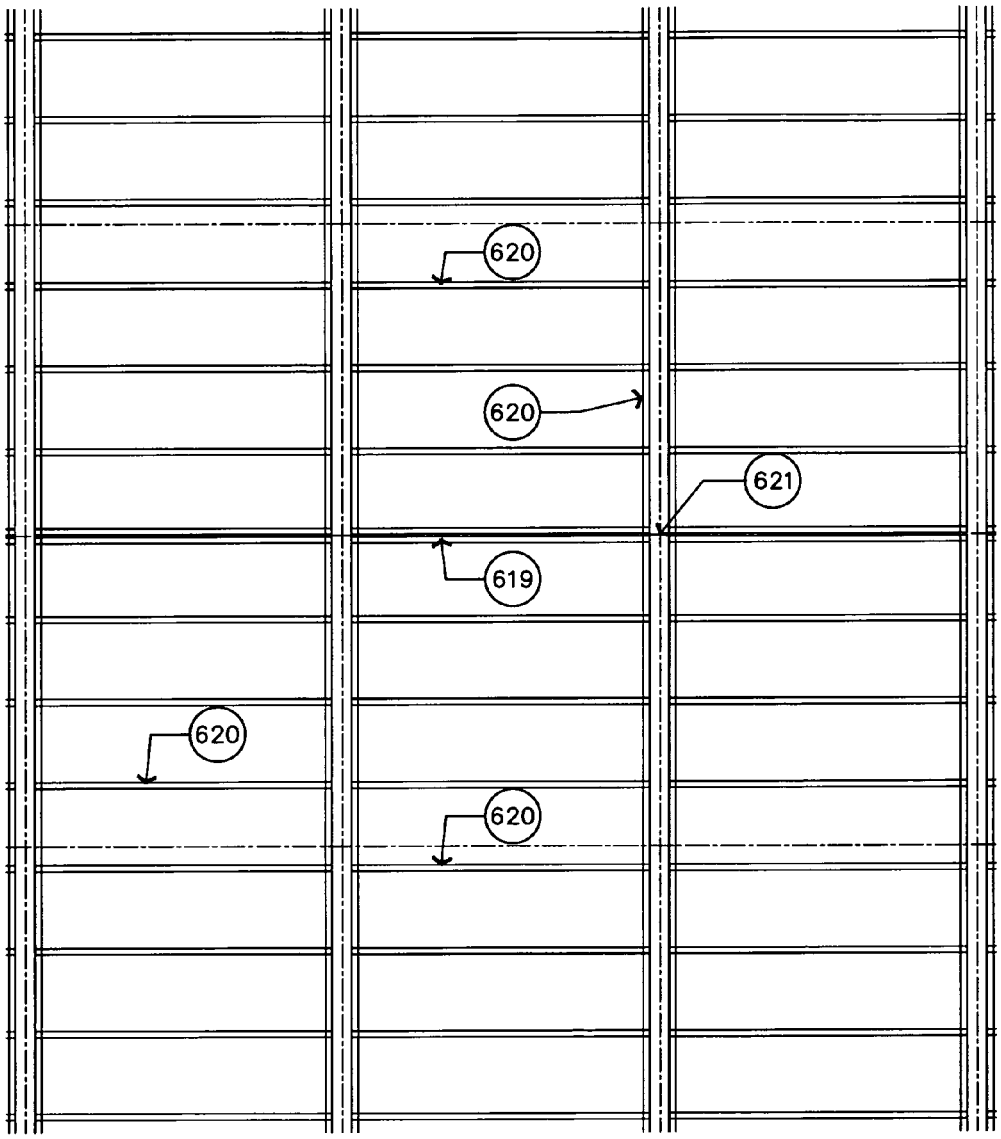

FIG. 6 illustrates a floor or ceiling panel layout with structural support elements.

Figure 7:
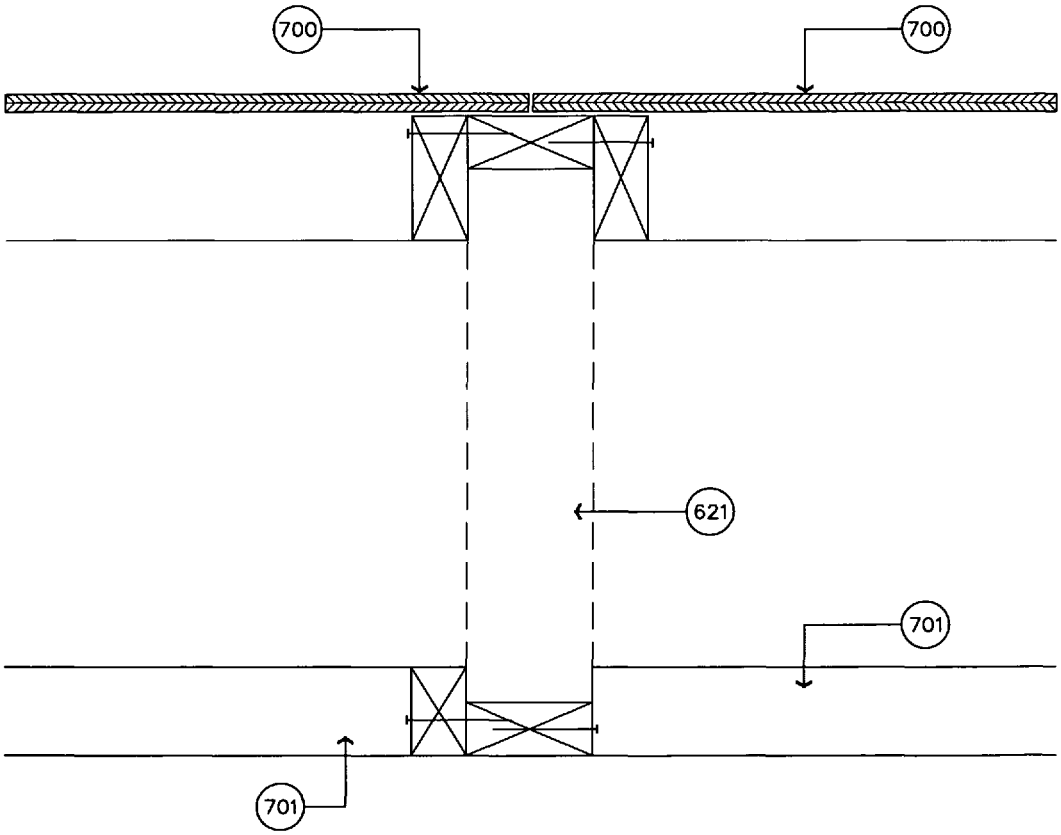
Figure 8:
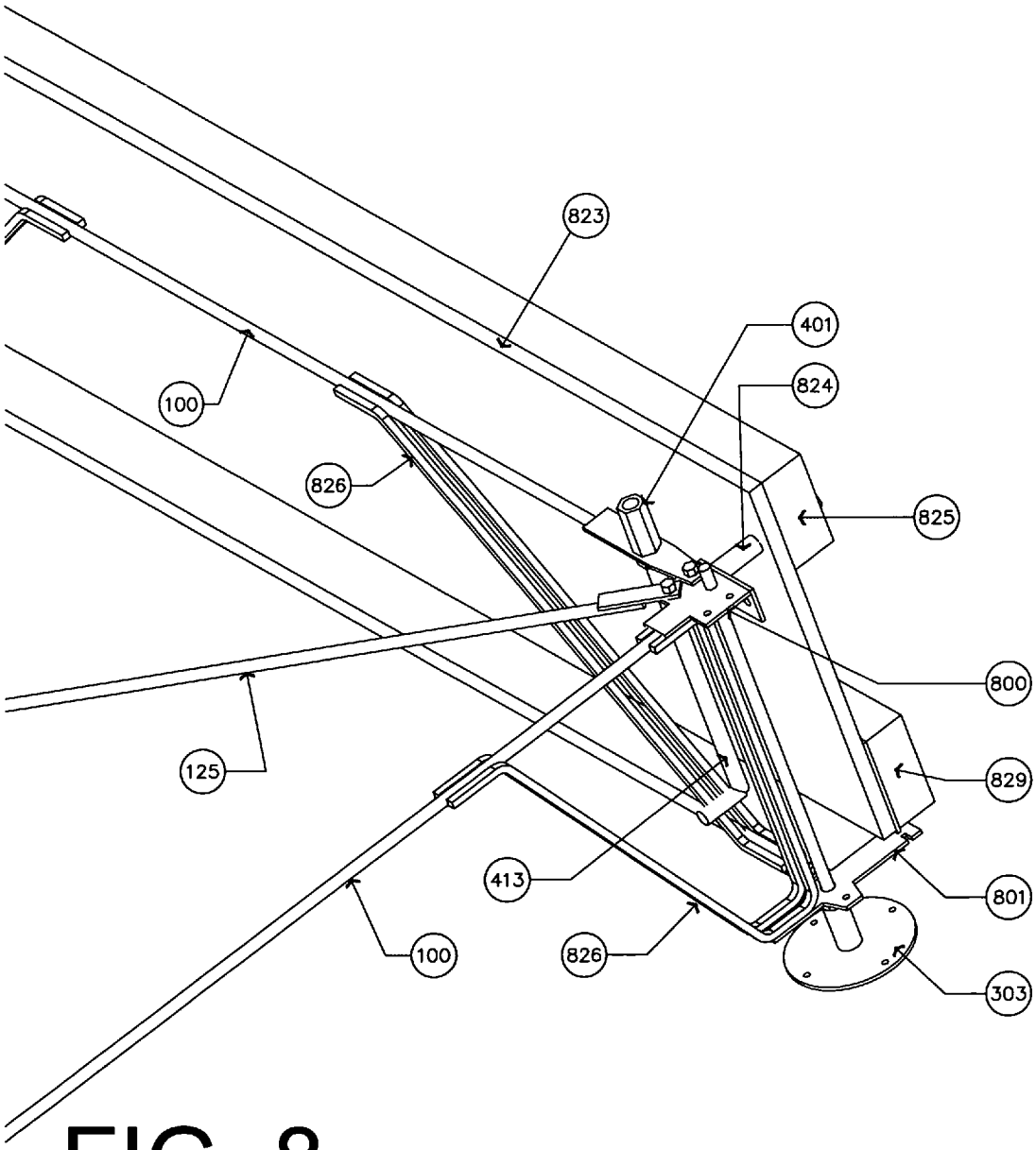

FIG. 7 illustrates a floor panel and ceiling panel attached to structural support FIG. 8 illustrates an edge form for use with the grid system of FIG. 1.

The present invention will be described with reference to the accompanying drawings. The drawing in which an element first appears is typically indicated by the leftmost digit(s) in the corresponding reference number.

DETAILED DESCRIPTION

In the following description, numerous specific details are set forth in order to provide a thorough understanding of the invention. However, it will be apparent to those skilled in the art that the invention, including structures, systems, and methods, may be practiced without these specific details. The description and representation herein are the common means used by those experienced or skilled in the art to most effectively convey the substance of their work to others skilled in the art. In other instances, well-known methods, procedures and components have not been described in detail to avoid unnecessarily obscuring aspects of the invention.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

1. OVERVIEW OF GRID SYSTEM

FIG. 1 provides an overhead view of a grid system for use in the floor of a building. Connectors 101 are spaced a regular distance from each other in a square or rectangular grid pattern. Rigid orthogonal spanners 100 are attached in-line to the connectors to provide even spacing between the connectors. A diagonal cross piece 125 is provided to square each grid.

As shown in FIG. 2, connector 101 provides attachment points for the grid system. A connection point 207 is provided for alignment of the connector's vertical position and additional functions including but not limited to an attachment point and hold down for walls and other building elements. Connection point 209 is provided for attachment to rigid spanner 100. Connection point 206 is provided for diagonal cross piece 125. Alternatively the connector plate can be rotated 90 degrees, with connections to the spanners and cross pieces rotated accordingly. In the embodiment shown FIG. 2 connector 101 is square, but as would be understood by one skilled in the art, it be rectangular or round and provide its intended purpose.

FIG. 3 illustrates connector 101 with spanners 100 and cross piece 125 attached. Additionally, height adjuster 302 is shown attached to connection point 207 and resting on bearing plate 303. Height adjuster 302 as shown in FIG. 3 incorporates a threaded surface for mating with the threaded surface of connection point 207. It is understood that the connection of height adjuster 302 to connection point 207 could be provided by any method that would allow for adjustment until fixed attachment is desired. As shown, height adjuster 302 is non-adjustably attached to bearing plate 303 while being adjustable at connection point 207, but as would be understood by one skilled in the art, height adjuster 302 could be alternatively adjustable at the bearing plate 303, or adjustable only at the bearing plate 303 while being nonadjustable at connection point 207. In a further embodiment height adjuster 302 would rest on bearing plate 303 without being otherwise attached.

In one embodiment attachment points for rebar, plumbing or heating provisions (such as hydronic heating) are provided on bearing plate 303, on connector 101 or on height adjuster 302.

In one embodiment a threaded surface could be machined into connection point 207 without the need of a threaded nut, or an alternative to a threaded nut could be used to provide a mating surface for the various attachment means for connection point 207. As shown spanner 100 is attached at connection point 209, and diagonal cross piece 125 is attached at connection point 206.

Spanner 100 and diagonal cross piece 125 could be made of various materials, including plastic, metal, composite, fiberglass or any other material that would provide compatibility with concrete or concrete equivalent while providing dimensional stability for the concrete and/or the grid system. In the shown embodiment spanner 100 and cross piece 125 are rectangular in cross-section, but could alternatively be round, square, triangular or other geometric shape.

Height adjuster 302 could be manufactured from metal, plastic, composite or any other material that could reliably provide for adjustment while being rigid enough to support and/or level the grid system during forming of the slab. Connector 101 could also be made of metal, composite, fiberglass or any other material that would provide a stable attachment point for other grid elements. Bearing plate 303 could be manufactured from metal, composite, fiberglass, wood or a moldable material such as concrete or plastic, including any material that can reliably provide a standoff from the surface under the floor. Temporary covers could also be provided for protection from the concrete or other material during installation. Additionally, finish covers could be manufactured from metal, composite, fiberglass, wood or a moldable material such as concrete or plastic, including any material that could provide durable flooring.

FIG. 4 is a detailed view of the wall panel 412 for the grid system. Anchor bolt 413 is adapted to attach to connector plate 800, which is a modification of connector 101 for use at the edge of the slab form. Coupler 401 receives the panel hold down bolt 415. In the embodiment shown wall panel 412 is attached after the floor is installed. In this embodiment anchor bolt 413 is attached to coupler 401. Wall panel 412 is modified to receive coupler 401 and anchor bolt 413 for rigid attachment to the installed floor. Wall panel 412 can be manufactured of traditional wall building materials and formed in a traditional manner. In the embodiment shown wall panel 412 is provided with cladding 417 and 419, which could be plywood, sheetrock (gypsum board) or other lightweight material such as lime plaster or other material that could provide for light weight low cost or otherwise be suitable for prefabrication. As shown wall panel 412 presents a cavity 411, which could be filled with insulating material or left unfilled. Additionally, the wall unit 412 could be manufactured with windows and other architectural elements built in.

FIG. 5 shows an embodiment for attachment of wall panel 412 to coupler 401 and a chase 516 for providing electrical and other wired materials in the wall panel as well as plumbing. Bracket 518 is rigidly attached to wall panel 412 and provides a connection point to the floor. As would be readily understood by one skilled in the art, bracket 518 could be manufactured as part of wall panel 412 or attached to wall panel 412 at the building site.

In addition to wall panels, other structural and architectural elements, including columns, stairs, and millwork pieces such as cabinets can be attached to connector plate 101 or connector plate 800.

FIG. 6 provides an embodiment of a ceiling and/or floor panel layout for the building system. Panel 620 is attached to structural support 621 with conventional methods, including but not limited to nails, screws or glue. Panel 620 is modified for intersection at edge 619. As would be readily understood by one skilled in the art, panel 620 could be alternately a ceiling or a floor panel and could be manufactured from a variety of materials, As would be further understood by one skilled in the art, ceiling and floor panels could be made of the same or different materials depending on the application.

FIG. 7 provides a detailed view of the intersection of the floor and ceiling panels to structural support elements. Floor panel 700 is attached to structural support 621. Ceiling panel 701 is also attached to structural support 621.

FIG. 8 shows an edge form 823 for use with the grid system. In one embodiment edge form 823 is removably attached to connector 800 by coupler 824 and to bottom connector plate 801. Coupler 824 can be a bolt and sleeve or any other attachment mechanism that would allow firm attachment and removal after the slab has cured sufficiently. Supports 825 and 829 provides support for edge form 823 and may be permanently or removably attached to edge form 823 as desired. As would be understood by one skilled in the art, orthogonal spanner 100 could be the same or modified when used at the edge form. Orthogonal spanner 100 can be modified at edge conditions to allow attachment of bottom connector plate 801 to edge form 823. In the embodiment shown attachment is accomplished with a brace 826. As would be understood by one skilled in the art, brace 826 could be preassembled on a modified orthogonal spanner 100 or provided separately for connection to orthogonal spanner 100 in the field.

5. CONCLUSION

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A system for building, comprising:

a plurality of in-line elements;

a plurality of diagonal elements;

a plurality of vertical elements;

a plurality of connector plates positioned in a grid pattern, each said connector plate configured for attachment to four of said in-line elements, at least two of said diagonal elements and one of said vertical elements;

wherein said vertical elements are movably attached to said connector plates and said in-line elements;

wherein said diagonal elements and said in-line elements are rigidly attached to said connector plates such that either a perpendicular or parallel relationship between adjacent said connector plates is maintained;

wherein one or more of said connector plates or said in-line elements are removably attached to slab edge forms to define an outside limit of at least a portion of a slab-on-grade foundation; and wherein said connector plates, said in-line elements, said diagonal elements and said vertical elements are substantially embedded in said slab-on-grade foundation.

2. The system of claim 1, wherein the vertical elements are movably attached to the connector plates with a threaded rod.

3. The system of claim 1, wherein the vertical elements are configured to rest on bearing plates opposite their connections to said connector plates.

4. The system of claim 1, wherein the connector plates are configured with holes for attachment of the in-line elements and the diagonal elements.

5. The system of claim 1, wherein at least one of the diagonal or the in-line elements is bolted to at least one of said connector plates.

6. The system of claim 1, wherein at least one of the diagonal or the in-line elements is welded to at least one of said connector plates.

7. A system for building, comprising:

a plurality of connector plates;

a plurality of vertical adjustment members, each said vertical adjustment member supporting at least one of said connector plates above a ground surface;

a plurality of diagonal cross members rigidly attached to one or more of said connector plates;

a plurality of in-line cross members rigidly attached to each end of one or more of said connector plates;

wherein the rigid attachment of the diagonal cross members and the in-line cross members to one or more of said connector plates maintains either a perpendicular or parallel relationship between adjacent said connector plates;

wherein the vertical adjustment members are adjustably attached to one or more of said connector plates and said in-line cross members;

wherein each of said diagonal cross members and at least two of said in-line cross members are of equal length;

wherein at least one of said connector plates or said in-line cross members are removably attached to slab edge forms to define an outside limit of at least a portion of a slab-on-grade foundation; and wherein said connector plates, said vertical adjustment members, said in-line cross members, and said diagonal cross members are substantially embedded in said slab-on-grade foundation.

8. The system of claim 7, wherein the vertical adjustment members are adjustably attached to the connector plates with a threaded rod.

9. The system of claim 7, wherein the vertical adjustment members are configured to rest on bearing plates opposite their connections to said connector plates.

10. The system of claim 7, wherein the connector plates are configured with holes for attachment of the in-line cross members and the diagonal cross members.

11. The system of claim 7, wherein at least one of the diagonal or in-line cross members are bolted to the connector plates.

12. The system of claim 7, wherein at least one of the diagonal or in-line cross members are welded to the connector plates.

* * * * *